US010799907B1

(12) United States Patent
Daranuta

(10) Patent No.: US 10,799,907 B1
(45) Date of Patent: Oct. 13, 2020

(54) SPREADING TOOL HAVING ATTACHABLE BLADES IN ORDER TO VARY THE WIDTH AND DEPTH OF DEPLOYMENT OF THE BLADE

(71) Applicant: Vitalie Daranuta, Miramar Beach, FL (US)

(72) Inventor: Vitalie Daranuta, Miramar Beach, FL (US)

( * ) Notice: Subject to any disclaimer, the term of this patent is extended or adjusted under 35 U.S.C. 154(b) by 0 days.

(21) Appl. No.: 16/295,882

(22) Filed: Mar. 7, 2019

Related U.S. Application Data

(63) Continuation-in-part of application No. 15/182,703, filed on Jun. 15, 2016, now Pat. No. 10,232,403.

(51) Int. Cl.

| | |
|---|---|
| ***B05C 17/10*** | (2006.01) |
| ***E04F 21/16*** | (2006.01) |
| ***E04F 21/24*** | (2006.01) |

(52) U.S. Cl.

CPC ..... *B05C 17/10* (2013.01); *E04F 21/16* (2013.01); *E04F 21/161* (2013.01); *E04F 21/162* (2013.01); *E04F 21/163* (2013.01); *E04F 21/24* (2013.01); *E04F 21/241* (2013.01)

(58) Field of Classification Search

CPC ..... B05C 17/10; E04F 21/0084; E04F 21/16; E04F 21/161; E04F 21/162; E04F 21/163; E04F 21/165; E04F 21/1652; E04F 21/24; E04F 21/241; E04F 21/32

USPC ..... 15/235.4, 235.6, 235.8, 236.01, 236.05, 15/236.06, 236.08, 236.09, 245, 245.1; 30/169, 172; 425/458

See application file for complete search history.

(56) References Cited

U.S. PATENT DOCUMENTS

| | | | | | |
|---|---|---|---|---|---|
| 2,179,563 | A * | 11/1939 | Sassano | E04F 21/1652 | 15/235.8 |
| 2,759,218 | A * | 8/1956 | Smith | E04F 21/32 | 425/458 |
| 4,892,056 | A * | 1/1990 | Hawkes | B05D 1/42 | 118/126 |
| 5,231,729 | A * | 8/1993 | Rose | B44D 3/105 | 15/145 |
| 6,308,370 | B1 * | 10/2001 | Southby | E04F 21/20 | 15/235.6 |

(Continued)

FOREIGN PATENT DOCUMENTS

| | | |
|---|---|---|
| DE | 674083 | * 4/1939 |
| EP | 456430 | * 11/1991 |
| FR | 2453962 | * 11/1980 |

(Continued)

*Primary Examiner* — Mark Spisich

(74) *Attorney, Agent, or Firm* — Peter Loffler

(57) ABSTRACT

A spreading tool allows width and depth variation of the spreading blade. A plate has first openings and second openings along with a first bottom edge. A blade has slots and is pressed against the plate so that the slots each align with a respective one first opening and a securement bolt is passed therethrough, the blade slid up or down against the plate so that the lower edge of the blade extends a desired distance below the bottom of the plate prior to bolt tightening. An extender has third openings and is pressed against the opposing surface of the plate so that its openings align with the second openings of the plate with securement bolts pass therethrough. A lower edge of the extender aligns with the bottom edge of the plate and extends beyond a side of the plate.

7 Claims, 7 Drawing Sheets

(56) References Cited

U.S. PATENT DOCUMENTS 6,412,185 B1 * 7/2002 Mills ..... E04F 21/04
33/464

FOREIGN PATENT DOCUMENTS

| | | | |
|---|---|---|---|
| GB | 2216169 | * | 10/1989 |
| JP | 57-177369 | * | 11/1982 |

* cited by examiner

SPREADING TOOL HAVING ATTACHABLE BLADES IN ORDER TO VARY THE WIDTH AND DEPTH OF DEPLOYMENT OF THE BLADE

This application is a Continuation-In-Part of U.S. patent application Ser. No. 15/182,703, filed on Jun. 15, 2016, now U.S. Pat. No. 10,232,403, which application is incorporated herein by reference in its entirety.

BACKGROUND OF THE INVENTION

1. Field of the Invention

The present invention relates to a tool for spreading an appropriate adhesive, such as mastic, wherein various sized blades are removably attachable to a main plate of the tool in order to adjust the width of the spreading tool blade as well as the depth of deployment of the blade and the surface texture.

2. Background of the Prior Art

Often, when installing tile, especially wall tile although sometimes with floor tile, a customer desires to have a relatively thin accent stripe of a different tile located between sections of the main tile being installed in order to achieve a desired look of the overall tile installation. Typically, the installer lays the main tile on either side of the location whereat the accent stripe is to be placed first, and once the main tile is laid, the installer lays the accent strip within the gap between the main tile sections to complete the job.

Accent stripe installation presents twin concerns for the tile installer. First, the gap between the two sections of main tile laid initially depends on the width of the accent stripe to be installed, which widths vary by tile as well as by the thickness of the desired grout line between the accent tile and the main tile. This presents a problem for the installer as the installer needs to spread an appropriate tile adhesive, such as mastic, in an even, uniform thickness so that the accent tiles adhere properly and their visible surface is flush with that of the main tile. However, the installer may only have a handful of spreading tools with standard width blades. If the width of the blades available to the installer do not match the width of the gap, the installer is forced to use a spreading tool that has a blade that is narrower than the gap width and to make two passes during the spreading of the adhesive within the gap, partially filling the gap with a first section of the adhesive during a first pass through the gap with the spreading tool, the width of this section being equal to the width of the blade of the spreading tool. Thereafter, the installer fills the remainder of the gap with the adhesive during a second pass through the gap with the spreading tool. The problem occurs during the second pass due to the fact that the spreading tool blade must also pass along a portion of the adhesive spread during the first gap pass which causes some of the adhesive being spreading during the second pass of the spreading tool through the gap to be pushed onto the first section of the adhesive, especially where the blade of the spreading tool overlaps the first section of adhesive. This results in a centrally disposed bugle or otherwise uneven spreading of the adhesive within the gap. When the accent tile is placed into gap, the tile is adhered mainly to the bugle either with little to no adherence to the non-bugle portions or with a tilt to one side or the other with the bulge acting as a fulcrum. In either instance, a poor install of the accent tile is achieved.

The other concern of the installer lays in the fact that often the main tile and the accent tile are of two different thicknesses. As the installer desires to have the visible surface of the main tile and the accent tile be flush with one another, the installer accounts for this thickness difference by adjusting the thickness of the adhesive laid within the gap. If the accent tile is thinner relative to the main tile, then the thickness of the adhesive is thicker within the gap relative to the adhesive thickness for the main tile, and vice versa. The problem is that adjusting the thickness to the desired level is no easy task and many installers simply eyeball the thickness and hope for the best in the final install. If the installer guesses correctly, no problem, however, if the installer does not guess correctly, then a poor install occurs.

To address these problems, spreading tools that have the ability to vary either the width of the blade or the depth of deployment of the blade have been proposed. While sometimes effective, such tools tend to be complex in design and construction so as to be relatively expensive to produce. Additionally, such tools tend to be difficult to adjust properly for a given job, resulting in lost installation time and frustration.

Accordingly, there is a need in the art for a tool for spreading adhesives and other spreadable material, which tool addresses the above described problems in the art. Specifically, such a tool must allow the width of the spreading blade as well as the depth of deployment of the spreading blade to each be adjustable. Such a tool must be simple in design and construction and be easy to deploy for a variety of jobs.

SUMMARY OF THE INVENTION

The spreading tool having attachable blades in order to vary the width and depth of deployment of the blade of the present invention addresses the aforementioned needs in the art by providing a tool that spreads adhesives and similar items with the blade of the tool deployed being variable in its width as well as its depth of deployment. The spreading tool having attachable blades in order to vary the width and depth of deployment of the blade is of simple design and construction, being produced using standard manufacturing techniques, so as to make the device relatively inexpensive to produce, making the device economically attractive to potential consumers for this type of product. The spreading tool having attachable blades in order to vary the width and depth of deployment of the blade is simple to deploy so that variation of either blade width or blade depth deployment is simple and easy, allowing the installer to primarily focus on the actual installation job at hand. The width of the blade being deployed as well as its deployment depth can be customized to almost any dimension in order to match the job at hand. The spreading tool having attachable blades in order to vary the width and depth of deployment of the blade allows the use of a blade that has two different blade ends, such as smooth and serrated in order to allow different surface textures of the material being spread. Switching between the two different blades is fast and easy.

The spreading tool having attachable blades in order to vary the width and depth of deployment of the blade of the present invention is comprised of a main plate that has a first top edge and an opposing first bottom edge, joined by a first side edge and an opposing second side edge. The main plate has a first surface and an opposing second surface. The main plate has a pair of first openings. A blade has a second top edge and an opposing second bottom edge joined by a third side edge and an opposing fourth side edge. The blade has a pair of parallel slots that extend between the second top edge and the second bottom edge. The blade is placed against the first surface of the main plate so that each slot of the blade aligns with a respective one of the first openings of the main plate and such that either the second top edge or the second bottom edge of the blade extends below the first bottom edge of the main plate whereby the second bottom edge or the second top edge will be located between the first top edge and the first bottom edge of the main plate. A pair of first securement bolts is provided such that each bolt passes through a respective one of the aligned slot-first opening pairs in order to secure the blade to the main plate and prevent their movement relative to one another. The second top edge of the blade is serrated while the second bottom edge of the blade is straight edged. A set of ruler markings is located along the third side edge of the blade (and possibly along the fourth side edge as well). A handle is located along the first top edge of the main plate. A pair of second openings is located on the main plate. An extender has a third top edge, a third bottom edge, a fourth bottom edge, a fifth side edge, and a sixth side edge. The extender has a pair of third openings such that the extender is placed against the second surface of the main plate so that each third opening of the extender aligns with a respective one of the second openings of the main plate and such that the fourth bottom edge of the extender longitudinally aligns with the first bottom edge of the main plate and extends beyond the first side edge of the main plate and such that the third bottom edge of the extender is located between the first top edge and the first bottom edge of the main plate. A pair of second securement bolts is provided so that each bolt passes through a respective one of the aligned second opening-third opening pairs in order to secure the extender to the main plate and prevent their movement relative to one another. Each of the pair of first openings of the main plate is located a first distance from the first bottom edge and each of the second openings of the main plate is located a second distance from the first bottom edge, the second distance being different relative to the first distance.

BRIEF DESCRIPTION OF THE DRAWINGS

Similar reference numerals refer to similar parts throughout the several views of the drawings.

DESCRIPTION OF THE PREFERRED EMBODIMENT

Figure 1:
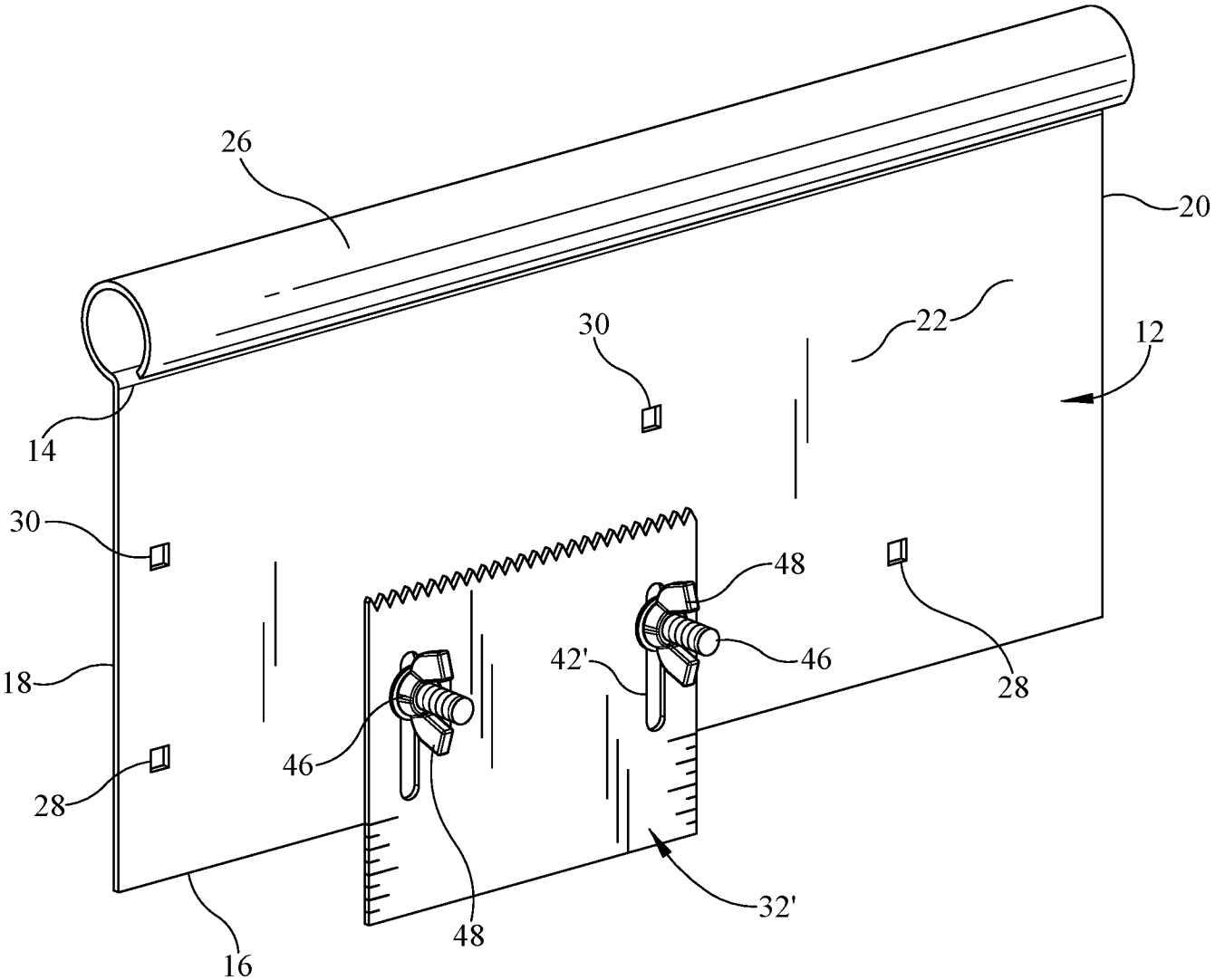
FIG. 1 is a perspective view of the spreading tool having attachable blades in order to vary the width and depth of deployment of the blade of the present invention.

Referring now to the drawings, it is seen that the spreading tool having a variable width and variable depth blade of the present invention, generally denoted by reference numeral 10, is comprised of a main plate 12 that has a first top edge 14 and a substantially straight first bottom edge 16 joined by a first side edge 18 and an opposing second side edge 20. The main plate 12 also has a first surface 22 and an opposing second surface 24. A handle 26 is located along the first top edge 14, and as seen, may be a continuation of the main plate 12, that is, the main plate 12 and the handle 22 are formed from a single sheet of material with the handle 26 formed into the desired shape. Alternately, the handle may be a separate item that is attached to the first top edge of the main plate. A series of first plate openings 28 is located on the main plate 12 all parallel with the first bottom edge 16 while a series of second plate openings 30 is also located on the main plate 12 all parallel with the first bottom edge 16.

Figure 2:
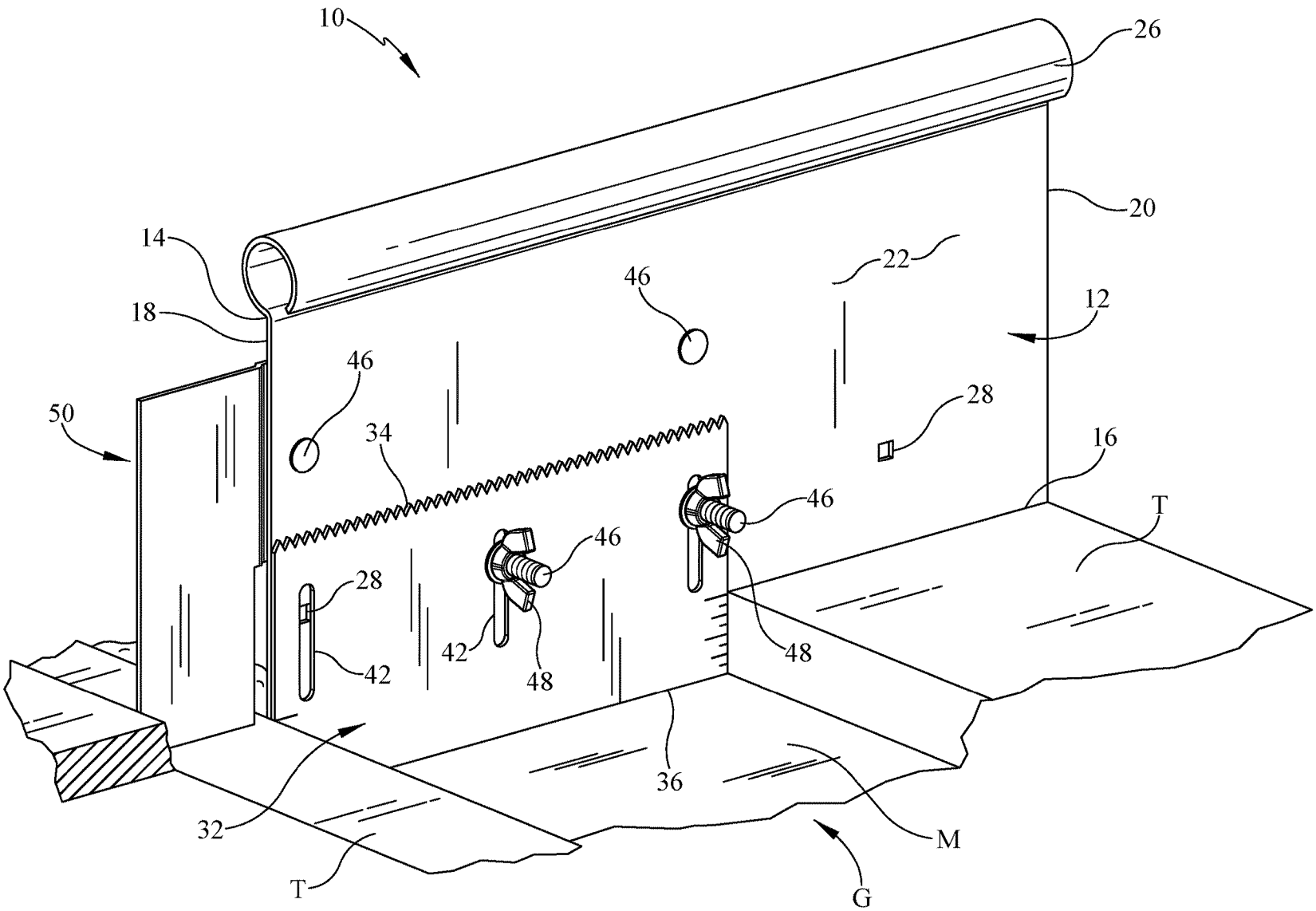
FIG. 2 is an environmental view of the spreading tool having attachable blades in order to vary the width and depth of deployment of the blade being used to spread an adhesive across a gap with the assistance of an extender.
Figure 3:
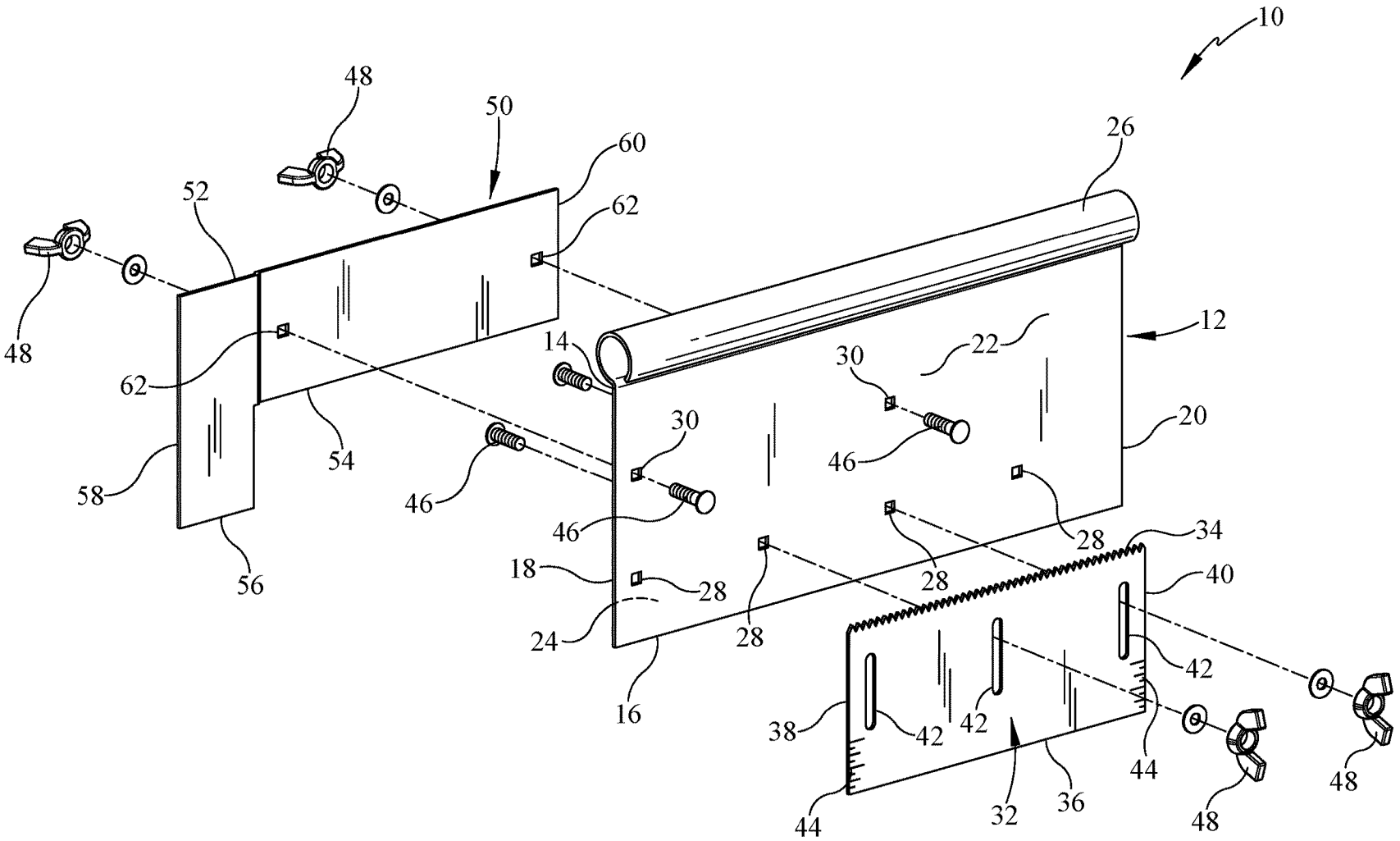
FIG. 3 is an exploded view of the spreading tool having attachable blades in order to vary the width and depth of deployment of the blade as configured in FIG. 2.
Figure 4:
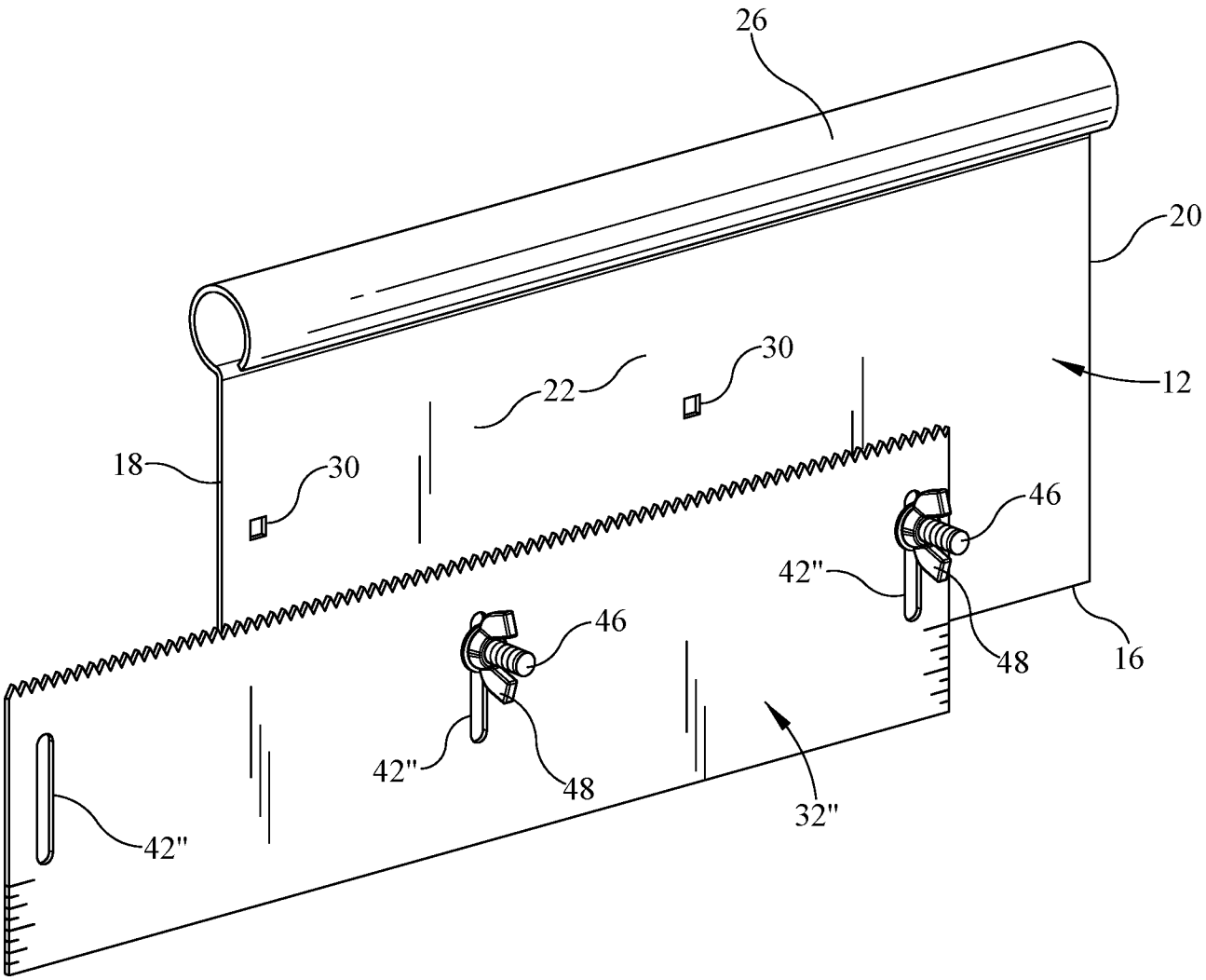
FIG. 4 is a perspective view of the spreading tool having attachable blades in order to vary the width and depth of deployment of the blade having a different blade attached.

A series of blade attachments of various shapes and sizes, is provided. As seen in FIGS. 2 and 3, one such blade is a blade 32 and has a serrated second top edge 34 and a substantially straight second bottom 36 joined by a third side edge 38 and an opposing fourth side edge 40. Two or more spaced apart slots 42 are located on this blade 32 with each slot 42 being vertically disposed, that is extending between the second top edge 34 and the second bottom edge 36. Depth markings 44 can be imprinted in appropriate fashion (printed thereon, etched or stamped thereinto, etc.,) along one or both side edges 38 and 40 of this blade 32. In order to use this blade 32, the blade 32 is positioned against the first surface 22 (or the second surface 24) of the main plate 12 so that at least two of the slots 42 of this blade 32 each align with one of the first plate openings 28 on the main plate 12. The blade 32 is positioned so that either the second top edge 34 or second bottom edge 36 extends below the first bottom edge 16 of the main plate 12, depending on whether a grooved spread of adhesive M or a straight spread of adhesive M is desired, respectively. An appropriate bolt 46 is passed through each aligned slot 42—first plate opening 28 pair and is secured in appropriate fashion such as via the illustrated wing nut 48. The depth of the working edge (either the second top edge 34 or second bottom edge 36 that extends below the first bottom edge 16 of the main plate 12) with respect to the first bottom edge 16 of the main plate 12 is adjusted by sliding the blade 32 either up or down as desired, the slots 42 through which the bolts 46 pass permitting such sliding. When the desired height is achieved, the wing nuts 48 are tightened to secure the blade 32 against the main plate 12 and prevent the movement of the main plate 12 and the blade 32 with respect to one another. The depth marking 44 can be used to assist a user in achieving the desired height. As seen in FIG. 1, a blade 32' can be relatively narrow, or as seen in FIGS. 4-6, a blade 32" can be relatively wide.

As seen in FIGS. 2 and 3, an extender 50 can be used to extend the width of the main plate 12. As seen, the extender 50 has a third top edge 52, a third bottom edge 54, a fourth bottom edge 56 located below the third bottom edge 54, a fifth side edge 58 and a sixth side edge 60. The extender 50 has at least two extender openings 62 thereon. In order to use this extender 50, the extender 50 is positioned against the second surface 24 (or the first surface 22 if the blade 32 is positioned against the second surface 24) of the main plate 12 so that two of the extender openings 62 of this extender 50 each align with a respective one of the second plate openings 30 on the main plate 12. In this position, the fourth bottom edge 56 of the extender 50 is longitudinally aligned with the first bottom edge 16 of the main plate 12 and extends beyond the first side edge 18 (or second side edge 20) of the main plate 12. An appropriate bolt 46 is passed through each aligned extender opening 62—second plate opening 30 pair and is secured in appropriate fashion such as via the illustrated wing nut 48. As seen in FIG. 2, this extender 50 is used in conjunction with the blade 32 whenever the main plate 12 is unable to fully span the entire gap G whereat the adhesive M is being spread so that the overall device rests on the tile surfaces T on both sides of the gap G, on one side, the first bottom edge 16 of the main plate 12 resting on the tile surface T and on the other side of the gap G, the fourth bottom edge 56 of the extender 50 resting on the tile surface T. The third bottom edge 54 of the extender 50 is located between the first bottom edge 16 and the first top edge 14 of the main plate 12.

Figure 5:
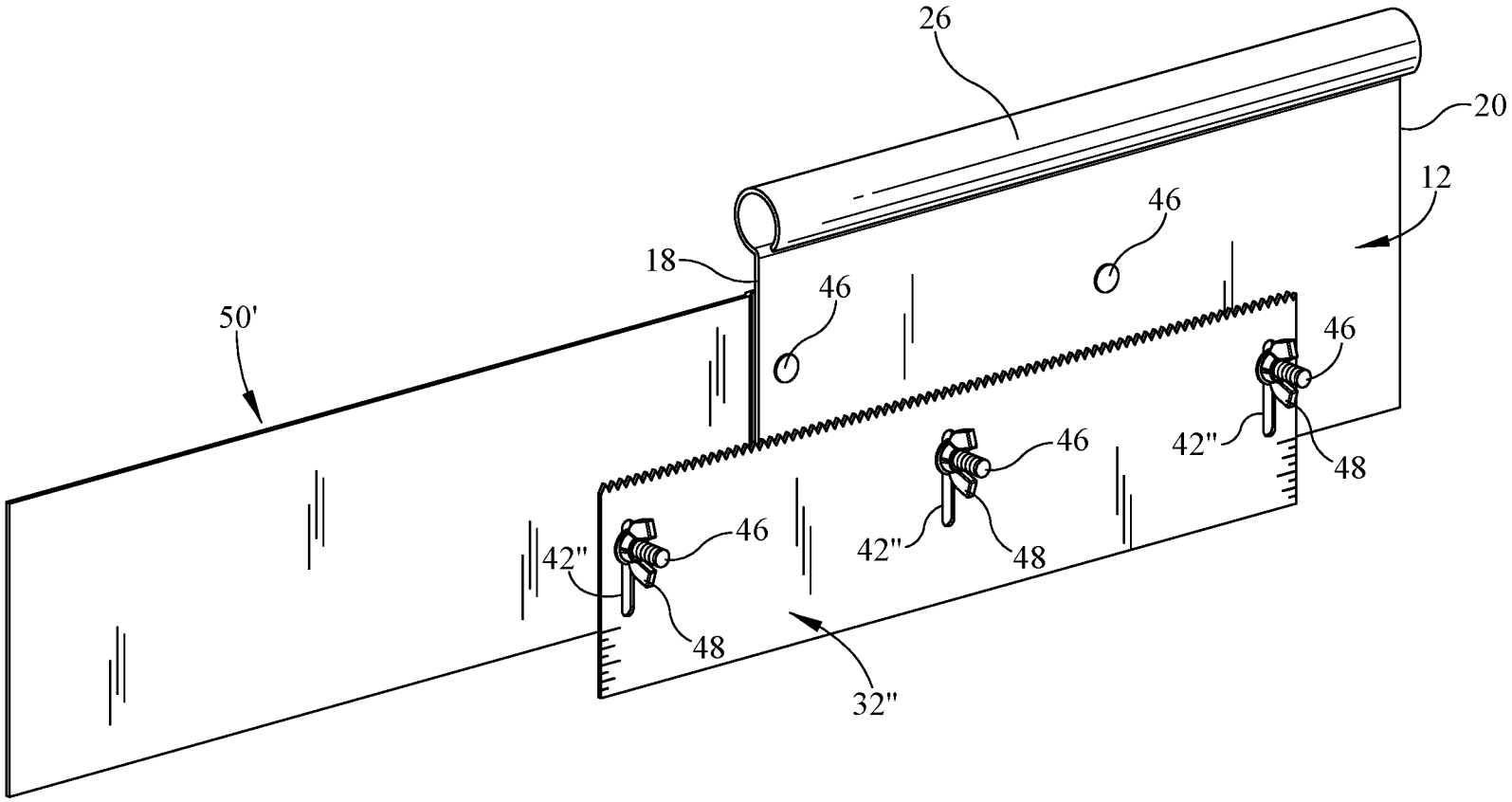
FIG. 5 is a perspective view of the spreading tool having attachable blades in order to vary the width and depth of deployment of the blade using a large extender.
Figure 6:
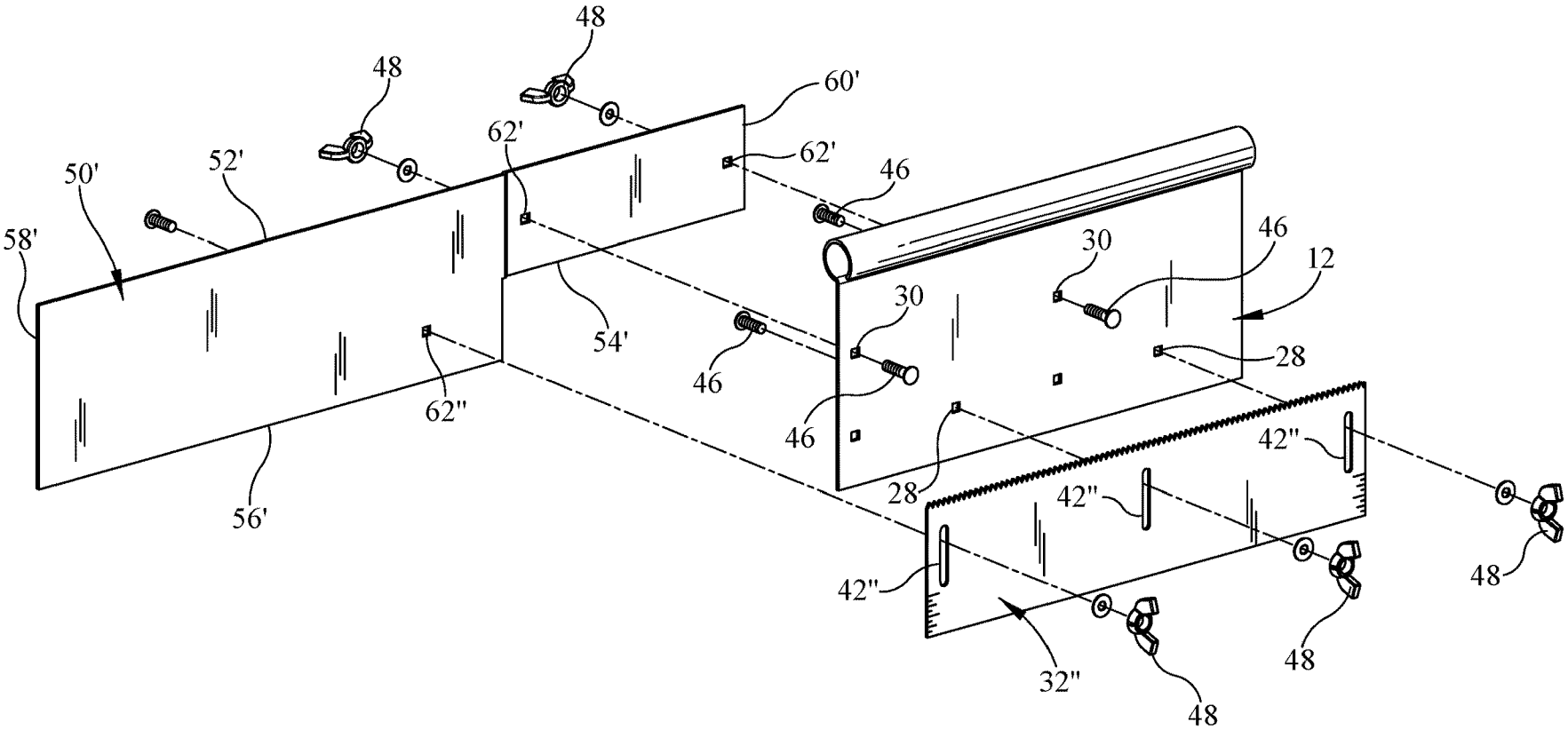
FIG. 6 is an exploded view of the spreading tool having attachable blades in order to vary the width and depth of deployment of the blade as configured in FIG. 5.
Figure 7:
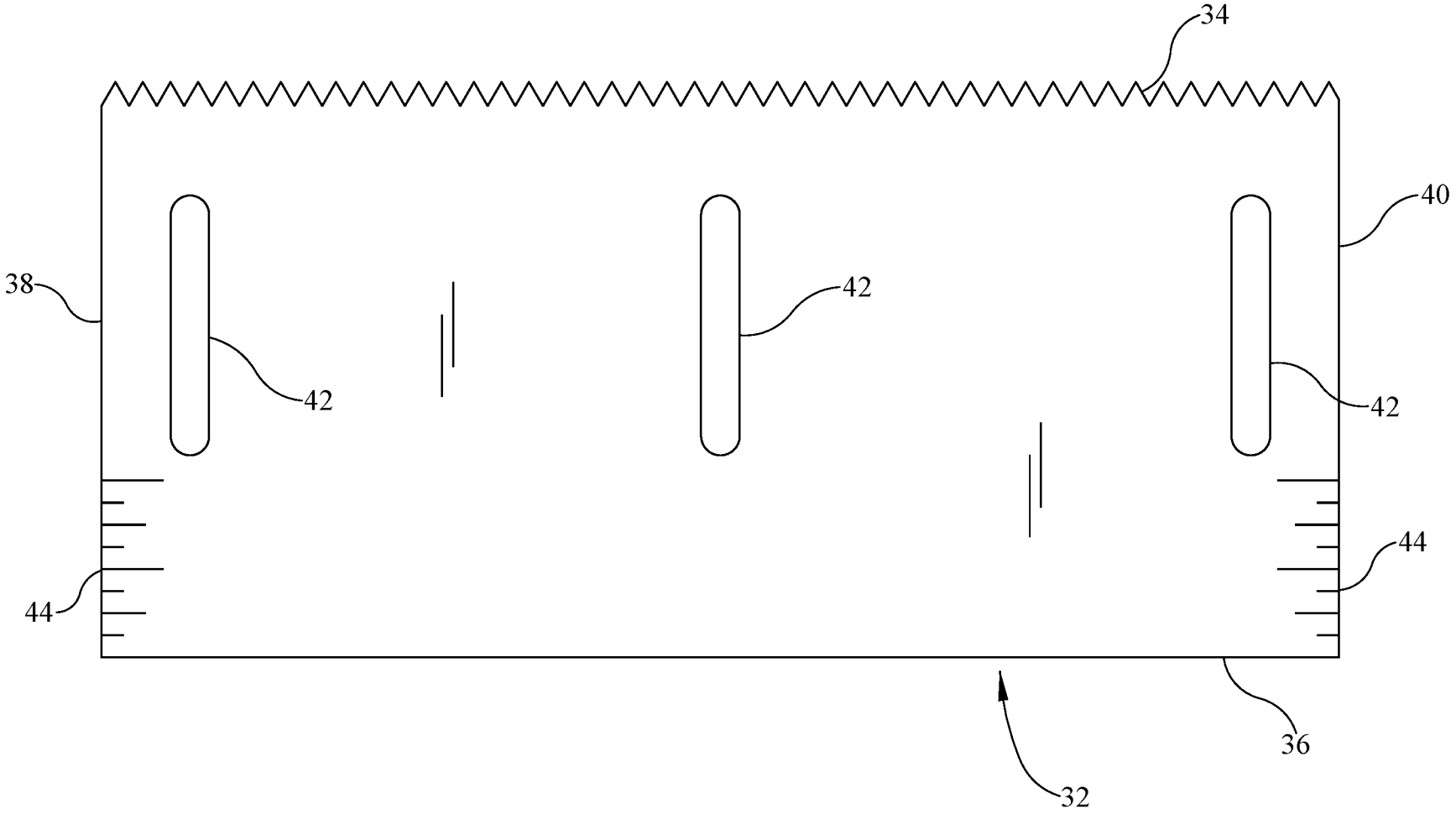
FIG. 7 is a plan view of one of the blades that is used with the spreading tool having attachable blades in order to vary the width and depth of deployment of the blade.

As seen in FIGS. 5 and 6, an oversized extender 50' can be used. As seen, the oversized extender 50' has a fourth top edge 52', a fifth bottom edge 54', a sixth bottom edge 56' located below the fifth bottom edge 54', a seventh side edge 58' and an eighth side edge 60'. The oversized 50' has at least two oversized extender openings 62' thereon. In order to use this oversized extender 50', the oversized extender 50' is positioned against the second surface 24 (or the first surface 22 if the blade 32 is positioned against the second surface 24) of the main plate 12 so that two of the oversized extender openings 62' of this oversized extender 50' each align with a respective one of the second plate openings 30 on the main plate 12. In this position, the sixth bottom edge 56' is longitudinally aligned with the first bottom edge 16 of the main plate 12 and extends beyond the first side edge 18 (or second side edge 20). An appropriate bolt 46 is passed through each aligned oversized extender opening 62'—second plate opening 30 pair and is secured in appropriate fashion such as via the illustrated wing nut 48. Similar to the extender 50 seen in FIGS. 2 and 3, this oversized extender 50' is used in conjunction with the blade 32 whenever the main plate 12 is unable to fully span the entire gap G whereat the adhesive M is being spread so that the overall device rests on the tile surfaces T on both sides of the gap G, on one side, the first bottom edge 16 of the main plate 12 resting on the tile surface T and on the other side of the gap G, the sixth bottom edge 56' of the oversized extender 50' resting on the tile surface T. The fifth bottom edge 54' of the oversized extender 50 being located between the first bottom edge 16 and the first top edge 14 of the main plate 12. The oversized extender 50' is chosen over the regular extender 50 whenever the gap G being spanned is relatively wide and the blade 32" being used is also relatively wide and additional tile surface T support is desired. As seen, the oversized extender 50' may have an additional slot opening 62" thereon to align with a slot 42" of the blade 32" being used so that a bolt 46 can be passed through this aligned slot 42"—slot opening 62" pair in order to secure this blade 32" to both the main plate 12 as well as the oversized extender 50' in order to achieve a secure blade 32' attachment The main plate 12, the blades 32, 32' and 32" and the extenders 50 and 50' are each made from a strong sturdy material such as steel, aluminum, hard plastic and the like.

In order to use the spreading tool having attachable blades in order to vary the width and depth of deployment of the blade 32 of the present invention, the desired blade 32 is selected and attached to the main plate 12 with the appropriate edge of the blade 32 (either serrated edge or straight edge) extending below the first bottom edge 16 of the main plate 12. The depth of the blade 32 below the first bottom edge 16 of the main plate 12 is set as desired and the blade 32 is secured to the main plate 12. If needed an appropriate extender 50 is attached to the opposing surface of the main plate 12 and secured thereto. The spreading tool having attachable blades in order to vary the width and depth of deployment of the blade 32 is now used as desired with the appropriate edge (34 or 36) of the blade 32 spreading the adhesive M within the gap G, the user grasping the device via its handle 26. Of course, the main plate 12 can be used without attachments so that the first bottom edge 16 of the main plate 12 spreads the adhesive M While the invention has been particularly shown and described with reference to an embodiment thereof, it will be appreciated by those skilled in the art that various changes in form and detail may be made without departing from the spirit and scope of the invention.

I claim:

1. A spreading tool comprising:

a main plate having a first top edge and an opposing first bottom edge, joined by a first side edge and an opposing second side edge, the main plate having a first surface and an opposing second surface, the main plate having a pair of first openings;

a blade having a second top edge and an opposing second bottom edge joined by a third side edge and an opposing fourth side edge, the blade having a pair of parallel slots that extend between the second top edge and the second bottom edge such that the blade is placed against the first surface of the main plate so that each slot of the blade aligns with a respective one of the first openings of the main plate and such that either the second top edge or the second bottom edge of the blade extends below the first bottom edge of the main plate whereby the second bottom edge or the second top edge is located between the first top edge and the first bottom edge;

a pair of first securement bolts each passing through a respective one of the aligned slot-first opening pairs in order to secure the blade to the main plate and prevent their movement relative to one another;

a pair of second openings located on the main plate;

an extender having a third top edge, a third bottom edge, a fourth bottom edge, a fifth side edge, and a sixth side edge, the extender having a pair of third openings such that the extender is placed against the second surface of the main plate so that each third opening of the extender aligns with a respective one of the second openings of the main plate and such that the fourth bottom edge of the extender longitudinally aligns with the first bottom edge of the main plate and extends beyond the first side edge of the main plate and such that the third bottom edge of the extender is located between the first top edge and the first bottom edge of the main plate; and a pair of second securement bolts each passing through a respective one of the aligned second opening-third opening pairs in order to secure the extender to the main plate and prevent their movement relative to one another.

2. The spreading tool as in claim 1 wherein the second top edge of the blade is serrated.

3. The spreading tool as in claim 2 wherein the second bottom edge of the blade is straight edged.

4. The spreading tool as in claim 1 further comprising a set of ruler markings located along the third side edge of the blade.

5. The spreading tool as in claim 1 further comprising a handle located along the first top edge of the main plate.

6. The spreading tool as in claim 1 wherein each of the pair of first openings is located equidistant from the first bottom edge.

7. The spreading tool as in claim 1 wherein each of the pair of first openings of the main plate is located a first distance from the first bottom edge and each of the second openings of the main plate is located a second distance from the first bottom edge, the second distance being different relative to the first distance.

* * * * *